United States Patent [19]

Mobsby

[11] 4,222,243

[45] Sep. 16, 1980

[54] FUEL BURNERS FOR GAS TURBINE ENGINES

[75] Inventor: John A. Mobsby, Draycott, England

[73] Assignee: Rolls-Royce Limited, London, England

[21] Appl. No.: 909,182

[22] Filed: May 24, 1978

[30] Foreign Application Priority Data

Jun. 10, 1977 [GB] United Kingdom ..... 24345/77

[51] Int. Cl.[3] ..... F02C 7/22

[52] U.S. Cl. ..... 60/742; 60/743; 60/748

[58] Field of Search ..... 60/39.74 B, 39.74 R; 239/403, 424.5

[56] References Cited

U.S. PATENT DOCUMENTS

| | | | |
|---|---|---|---|
| 3,099,910 | 8/1963 | Schirmer | 60/39.74 R |
| 3,703,259 | 11/1972 | Sturgess et al. | 60/39.74 R |
| 3,820,320 | 6/1974 | Schirmer et al. | 60/39.74 R |
| 3,938,324 | 2/1976 | Hammond et al. | 60/39.74 R |

FOREIGN PATENT DOCUMENTS

| | | | |
|---|---|---|---|
| 235713 | 11/1910 | Fed. Rep. of Germany | 239/403 |
| 568792 | 10/1975 | U.S.S.R. | 239/403 |

*Primary Examiner*—Robert E. Garrett

*Attorney, Agent, or Firm*—Cushman, Darby & Cushman

[57] ABSTRACT

Fuel is injected through very fine holes normally into a swirled airstream. A finally atomized fuel results and a solid cone of fuel and air passes into the combustion chamber. The injector gives high combustion efficiency at idle conditions reduces smoke at high power conditions.

5 Claims, 2 Drawing Figures

FUEL BURNERS FOR GAS TURBINE ENGINES

This invention relates to fuel burners for gas turbine engines.

Fuel burner design has been changed over recent years from the type employing the fuel pressure jet principle to those using the air-assisted principle. The primary motivation for this change has been the requirement to reduce the production of smoke as the pressure level within gas turbine high pressure spools has increased.

Usually air-assisted burners feature the injection of fuel tangentially into a circular or annular air passage in which there is a high velocity air flow. This creates a cylindrical liquid sheet adjacent to the wall of the air passage and the resulting fuel placement in the combustion chamber of a gas turbine engine is in the form of a hollow cone. The fuel/air mixture is thus consequently very rich about the fuel sheet, and large amounts of smoke can still be produced. At low engine power conditions, the spray can have a wide range of droplet sizes which are related to the thickness of the fuel sheet presented to the incident airstream.

It is an object of the present invention to provide a fuel burner for a gas turbine engine which will provide a spray in the form of a solid cone of finely atomised fuel.

According to the present invention a fuel burner suitable for a gas turbine engine comprises a hollow duct intended to receive a flow of air, swirl means located adjacent to the upstream end of the hollow duct and a plurality of orifices formed in the wall of the hollow duct downstream of the swirl means, the orifices being adapted to direct fuel into the hollow duct transversely thereof whereby to produce a swirling mixture of atomised fuel and air within the hollow duct.

The hollow duct may be surrounded by a wall spaced from the hollow duct to define an annular passage therebetween, the annular passage being provided with further swirl means.

The further swirl means are preferably located adjacent to the downstream end of the hollow duct.

The swirl means and the further swirl means preferably comprise a series of spaced vanes.

Preferably two or more circumferentially arranged sets of orifices are formed in the wall of the hollow duct, a first set adapted to provide a low fuel flow rate for low power conditions of the engine, and a second set or subsequent sets adapted to provide a higher fuel flow rate for high power conditions of the engine.

The first set of orifices are preferably located adjacent the downstream end of the hollow duct, whilst the second or subsequent sets may be positioned substantially midway or substantially equi-spaced between the swirl means and the first set of orifices.

The invention also comprises a gas turbine engine having a fuel burner as set forth above.

Figure 1:
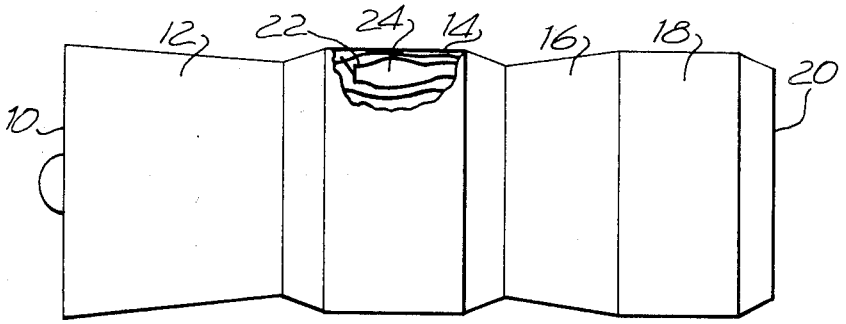
Figure 2:
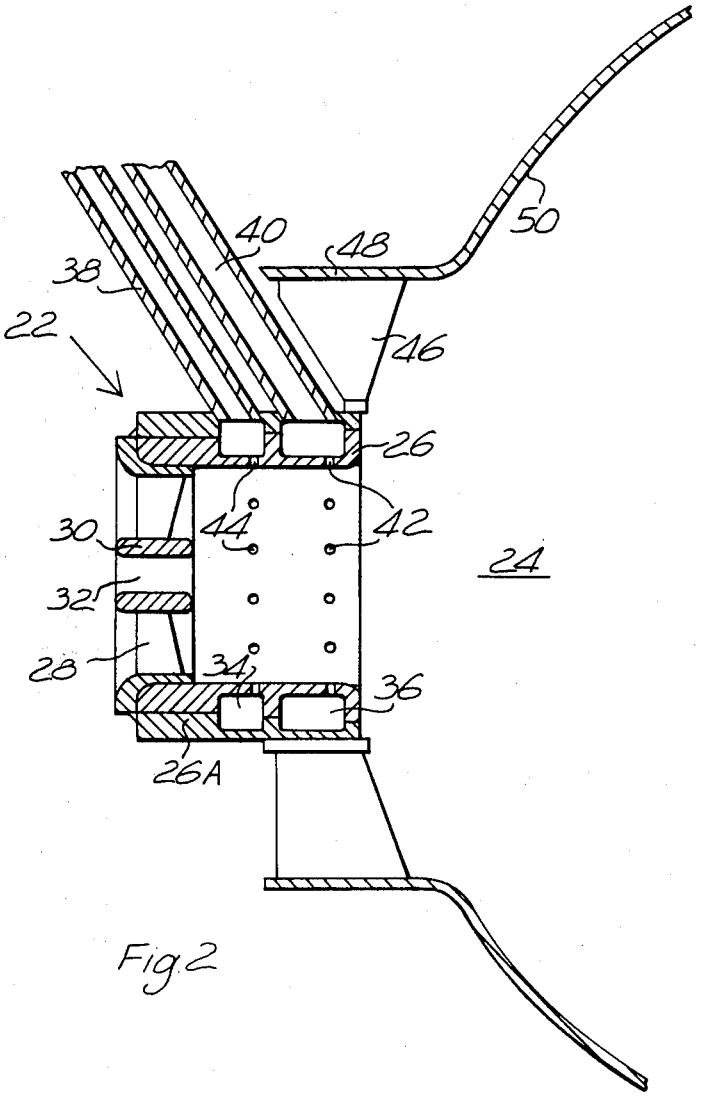

An embodiment of the invention will now be described by way of example only with reference to the accompanying drawings in which:

FIG. 1. illustrates a gas turbine engine having a fuel burner in accordance with the inventon and FIG. 2 is an enlarged cross-sectional view of the burner.

In FIG. 1 there is shown a gas turbine engine comprising an air intake 10, compressor means 12, combustion equipment 14, turbine means 16, a jet pipe 18 and an exhaust nozzle 20.

The combustion equipment comprises an annular flame tube 24 of known type, at the upstream end of which is located a number of equi-spaced circumferentially arranged burners 22. One of these burners is illustrated in more detail in FIG. 2 and consists basically of a hollow cylinder 26 open at both ends. A set of swirl vanes 28 is arranged at the upstream end of the cylinder 26, the inner ends of the swirl vanes being supported by a hub 30. Through the hub 30 is formed a hole 32 which is intended to prevent the formation of carbon on the hub.

In the wall of the cylinder 26 are formed two annular manifolds 34 and 36 and these are intended to be supplied with fuel from a fuel control unit via supply tubes 38 and 40 respectively. The supply tube 40 supplies a low flow rate of fuel to the manifold 36 for engine idle and low power conditions and the supply tube 38 supplies a higher controlled rate of flow of fuel to the manifold 34 for high power conditions of the engine.

A number of small circumferentially arranged orifices 42 communicate the manifold 36 with the interior of the cylinder 26, typically 8 orifices. Similarly a number of small circumferentially arranged orifices 44 communicate the manifold 34 with the interior of the cylinder 26, typically 14, or for a larger fuel burner, 20 orifices. These orifices are small, in this case they are holes with a diameter of 0.015 inches and are arranged to direct fuel normal to the axis of the burner and to meter the flow of fuel into the cylinder 26. The holes 42 are arranged adjacent to the downstream end of the cylinder 26, and the holes 44 are arranged approximately midway between the swirl vanes 28 and the holes 42.

The cylinder 26 is supported in the upstream end of the combustion chamber 24 by a further set of swirl vanes 46, the outer ends of which are secured to an annular ring 48. The annular ring 48 is joined to the upstream end 50 or base plate of the combustion chamber 24. An annular passageway is therefore defined between the annular ring 48 and the outer surface of the cylinder 26 for entry of primary combustion air into the combustion chamber. The swirl vanes 46 may be arranged to swirl air passing therethrough in the opposite direction to the swirl imparted to the air passing through the swirl vanes 28, or in the same direction.

During operation of the engine, a high speed flow of air enters the burner, some of the air passing through the swirl vanes 46 and some passing through the swirl vanes 28 into the cylinder 26. Fuel is injected through the sets of holes 42 or 44 or both sets such that the fuel penetrates into the swirled airstream and does not impact on the internal surfaces of the cylinder 26. The fuel is atomised and this is enhanced by ensuring that the relative velocity of the fuel and air is at a maximum and by using the very small holes 42 and 44 which are as small as permissible without inducing possible blockage problems. The dispersion of the fuel droplets upon atomisation causes a solid cone of fuel/air mixture to issue from the downstream end of the cylinder, and the very finely atomised fuel confers a high combustion efficiency to the burner and reduces the possibility of smoke formation at high engine power conditions.

A third set of fuel holes could be used and in this case the three sets could be approximately equally spaced between the swirl vanes 28 and the downstream end of the cylinder 26.

The preferred angle of the swirl vanes 28 to the axis of the burner is approximately 25 degrees, but smaller angles, and angles up to 45 degrees can be used. Too large an angle however causes the fuel to be centrifuged on to the cylinder walls, and it has been found that the angle of 25 degrees produces a preferred flame pattern.

The position of the swirl vanes 46 is not critical, for example they could be located at the upstream end of the cylinder 26.

The downstream end of the cylinder 26 may be in the form of a bell mouth to reduce the possibility of carbon deposits forming around the downstream end of the cylinder 26.

The fuel burner is also suitable for use in tubular combustion chambers and tubo-annular combustion chambers.

I claim:

1. A fuel injector suitable for a gas turbine engine comprising:

a hollow, open-ended circular section duct defining a cylindrical wall, said circular section duct having an upstream end arranged to receive a flow of compressed air and a downstream end to discharge a mixture of compressed air and fuel;

swirl means positioned at the upstream end of said circular duct, said swirl means comprising a plurality of spaced vanes extending inwardly from said cylindrical wall;

a centrally positioned, hollow, open-ended hub at the upstream end of said circular section duct, said inner ends of said vanes being supported by said hub;

a first set of fuel orifices in the wall of said cylindrical section duct adjacent the downstream end thereof for providing a low fuel flow rate at low power conditions of said engine;

a second set of fuel orifices in the wall of said circular section duct positioned upstream of said first set and downstream of said swirl means for providing a higher fuel flow rate at high power conditions of said engine;

fuel manifolds arranged to communicate respectively to said first and second sets of fuel orifices for supplying fuel thereto; and a cylindrical wall spaced outwardly of the cylindrical wall of said circular section duct to define an annular air flow passage having an open, upstream end and an open, downstream end, said annular air flow passage being coaxial with said circular section duct and having its upstream end also coaxial with the upstream end of said circular section duct; and a further swirl means in said annular air flow passage, said further swirl means including a plurality of spaced vanes.

2. A fuel injector as claimed in claim 1 in which said second set of fuel orifices is spaced substantially midway between the swirl means of said circular section duct and said first set of orifices.

3. A fuel injector as claimed in claim 2 in which said first set of orifices and said second set of orifices are each arranged to direct fuel normal to the axis of said circular section duct.

4. A fuel injector as claimed in claim 3 in which said fuel orifices of said first and second sets of orifices have a diameter in the order of 0.015 inch.

5. A fuel injector as claimed in claim 4 in which said swirl vanes in said circular section duct each have an angle with the axis of said circular section duct in the order of 25 degrees.

* * * * *